US010852667B2

(12) United States Patent
Cohen et al.

(10) Patent No.: US 10,852,667 B2
(45) Date of Patent: Dec. 1, 2020

(54) ALTERING THE OPERATION OF PRINTING DEVICES HAVING ENGAGEABLE COMPONENTS

(71) Applicant: HP Indigo B.V., Amstelveen (NL)

(72) Inventors: Lavi Cohen, Ness Ziona (IL); Alon Froom, Ness Ziona (IL); Amit Porat, Ness Ziona (IL); Asaf Shoshani, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/346,132

(22) PCT Filed: Jan. 26, 2017

(86) PCT No.: PCT/EP2017/051680
§ 371 (c)(1),
(2) Date: Apr. 30, 2019

(87) PCT Pub. No.: WO2018/137770
PCT Pub. Date: Aug. 2, 2018

(65) Prior Publication Data

US 2020/0050130 A1 Feb. 13, 2020

(51) Int. Cl.
*G03G 15/10* (2006.01)
*G03G 15/00* (2006.01)

(52) U.S. Cl.
CPC ..... *G03G 15/10* (2013.01); *G03G 15/6529* (2013.01); *G03G 2215/00679* (2013.01)

(58) Field of Classification Search
CPC ..... G03G 15/0121; G03G 21/1647; G03G 2221/1657; G03G 15/0896; G03G 21/1676
See application file for complete search history.

(56) References Cited

U.S. PATENT DOCUMENTS 5,497,659 A 3/1996 Roder
6,715,751 B2 6/2004 Henn
(Continued)

FOREIGN PATENT DOCUMENTS

JP S5910977 A 1/1984

OTHER PUBLICATIONS

Adjusting the Bid Engage and Disengage Angle, <http://support.hp.com/in-en/document/c01766077#AbT5 >.
(Continued)

*Primary Examiner* — Walter L Lindsay, Jr.
*Assistant Examiner* — Jessica L Eley
(74) *Attorney, Agent, or Firm* — Dierker & Kavanaugh PC

(57) ABSTRACT

In an example, a printing device comprises a component to engage with a surface, a first load sensor, a second load sensor and a controller. The component has a first part which is drivable to engage and disengage with the surface by a first engagement device and a second part which is drivable to engage and disengage with the surface by a second engagement device. The first load sensor is to measure a load on the first engagement device. The second load sensor is to measure a load on the second engagement device. The controller is to receive first load information from the first load sensor and second load information from the second load sensor; and determine whether or not to alter an operational parameter of the printing device, based on the received first load information and the received second load information.

11 Claims, 8 Drawing Sheets

(56) References Cited

U.S. PATENT DOCUMENTS

| | | | | |
|---|---|---|---|---|
| 7,481,429 | B2 | 1/2009 | Eckart et al. | |
| 8,839,718 | B2 | 9/2014 | Wiener et al. | |
| 8,923,746 | B2 | 12/2014 | Nakamura et al. | |
| 2010/0288146 | A1* | 11/2010 | Levanon | G03G 15/50 101/248 |
| 2015/0071659 | A1* | 3/2015 | Iikura | G03G 15/556 399/27 |

OTHER PUBLICATIONS

Al-Mutlaq, S., Getting Started with Load Cells < https://learn.sparkfun.com/tutorials/getting-started-with-load-cells >.

* cited by examiner

ALTERING THE OPERATION OF PRINTING DEVICES HAVING ENGAGEABLE COMPONENTS

BACKGROUND

Liquid electrophotographic printing, also referred to as liquid electrostatic printing, uses "liquid toner" (a liquid having electrically charged particles dispersed therein) to form images on a print medium. A liquid electrophotographic printer may use digitally controlled lasers to create a latent image in the charged surface of an imaging element such as a photo imaging plate (PIP). In this process, a uniform static electric charge is applied to the PIP and the lasers dissipate charge in certain areas creating the latent image in the form of an invisible electrostatic charge pattern conforming to the image to be printed. An electrically charged printing substance, in the form of liquid toner, is then applied and attracted to the partially-charged surface of the PIP, recreating the desired image.

BRIEF DESCRIPTION OF THE DRAWINGS

Various features will be apparent from the detailed description which follows, taken in conjunction with the accompanying drawings, which together illustrate, by way of example only, certain examples, and wherein.

DETAILED DESCRIPTION

In the following description, for purposes of explanation, numerous specific details are set forth in order to provide a thorough understanding of the present systems and methods. It will be apparent, however, that the present apparatus, systems and methods may be practiced without these specific details. Reference in the specification to "an example" or similar language means that a particular feature, structure, or characteristic described in connection with the example is included in at least that one example, but not necessarily in other examples.

In certain liquid electrophotographic printers, a transfer element is used to transfer developed liquid toner to a print medium. For example, a developed image, comprising liquid toner aligned according to a latent image, may be transferred from a PIP to a transfer blanket of a transfer cylinder and from the transfer blanket to a desired substrate, which is placed into contact with the transfer blanket. In some electrophotographic printers, a binary ink developer (BID) comprises the liquid toner which is transferred to the PIP. The liquid toner may comprise ink, for example in the form of ink particles in a carrier liquid. More than one BID can be used, each BID comprising different color ink. The ink or pigment particles are charged and may be arranged upon the PIP based on a charge pattern of a latent image. Once liquid toner is applied to the latent image on the PIP, an inked image is formed on the PIP. The inked image comprises ink particles that are aligned according to the latent image. An example BID includes a developer roller which contacts, or engages, the PIP to allow the ink to be electrostatically and mechanically transferred from the BID to the PIP.

Figure 1A:
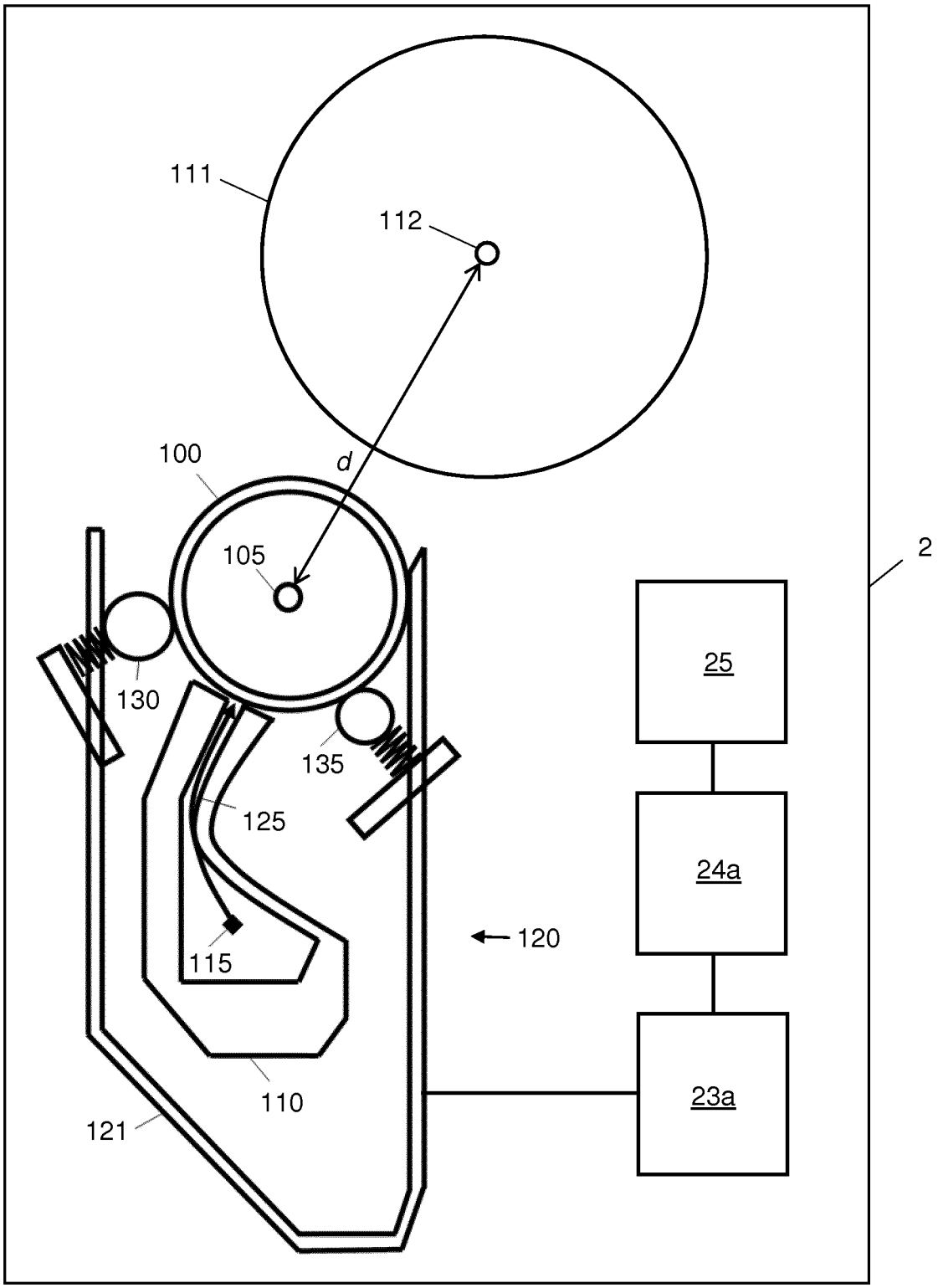
FIG. 1*a* is a schematic diagram showing an example printing device.
Figure 1B:
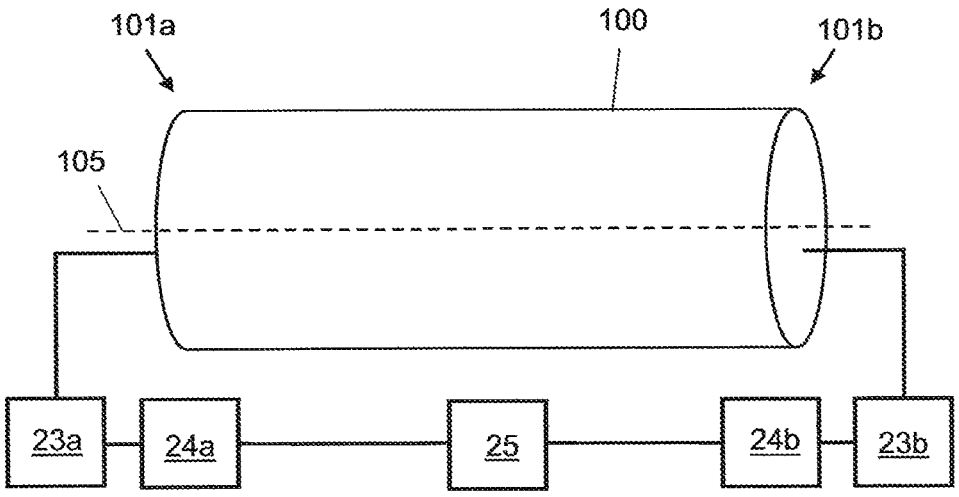
FIG. 1*b* is a schematic diagram showing a developer roller of the example printing device of FIG. 1*a;*

FIG. 1*a* is a schematic diagram showing a binary ink developer 120 (BID) in accordance with an example, and FIG. 1*b* shows a developer roller 100 of the BID 120 in isolation. The BID 120 is comprised in a printing device 2, which is described in further detail below, with reference to FIG. 2. The BID 120 may be considered to be a component of the printing device 2 which is to engage with a surface, which in the particular example is the surface of a PIP 111. The engagement and disengagement of the BID 120 with the PIP 111 is drivable by first and second engagement devices 23*a*, 23*b* (only the first engagement device 23*a* is visible in FIG. 1*a*). The printing device 2 also comprises first and second load sensors 24*a*, 24*b* (only the first load sensor 24*a* is visible in FIG. 1*a*) and a controller 25. The engagement mechanisms 23*a*, 23*b*, load sensors 24*a*, 24*b* and controller 25 are depicted as simple functional blocks in FIGS. 1*a* and 1*b*. The structure and operation of these features will be described below with reference to FIG. 2. In examples described herein, a "printing device" may be a device to create a print product by depositing a printing fluid (e.g., ink) on a physical material (e.g., paper, etc.). A printing device may utilize any suitable printing consumable, such as ink, toner, fluids or powders, or other raw materials for printing.

The BID 120 comprises a BID base 121. The BID 120 further comprises a developer roller 100 comprising a surface for transferring ink applied thereto to the PIP 111. In this example, the developer roller 120 is a cylindrical roller which rotates about an axis 105. In other examples, the developer roller 100 may be of a different form, such as a belt or plate. In this example, the BID 120 comprises an ink inlet 115 and electrodes 110. Ink for application to the surface of the developer roller 100 is positively or negatively charged and enters the BID 120 through the ink inlet 115, for example from an ink reservoir. The electrodes 110 are held at an electrical potential, the same polarity as the charged ink. The surface of the developer roller is electrically conductive and in use is held at an electrical potential which is less than the potential of the electrodes. The potential difference between the developer roller 100 and the electrodes 210 causes the ink to be electrostatically transferred from the ink inlet 115 to the surface of the developer roller 100. Arrow 125 illustrates the direction of ink flow. In addition, the BID 120 may comprise a pressure roller 130, such as a squeegee roller in contact with the developer roller 100 for applying pressure to the surface of the developer roller 100. This application of pressure by the pressure roller 130 skims the ink that has been applied to the developer roller 100 so that the ink is more solid than liquid. The BID 120 may also comprise a cleaner roller 135 which cleans unused ink from the developer roller 100.

Contacting both ends of the developer roller against the PIP roller simultaneously, and also maintaining the developer roller against the PIP roller with a fixed and uniform force, facilitate obtaining a good print quality because ink is transferred in the process. For example, a uniform force between the developer and the PIP can ensure a uniform optical density of the resulting print product.

The PIP 111 may be implemented as a drum or a belt. The BID 120 is to deposit a layer of liquid toner onto the PIP 111. The liquid toner is applied by bringing the developer roller 100 into contact with the surface of the PIP 111. The liquid toner is then transferred to the PIP 111 through a combination of mechanical and electrostatic forces. In an example, the developer roller 100 rotates about the axis 105 and the PIP rotates about a separate axis 112. These axes may be substantially parallel. The developer roller 100 and PIP 111 can be engaged and disengaged by changing the inter-axial distance d between the developer roller and the PIP. In the engaged position, liquid toner can be transferred from the developer roller 100 to the PIP 111. For example, starting from a disengaged position, the inter-axial distance d may be reduced until the developer roller 100 and PIP 111 engage. Once engaged, the inter-axial distance d may be reduced further. This increases the contact/engagement force between the developer roller 100 and the PIP 111. This contact region is sometimes known as the nip.

The inter-axial distance d between the developer roller 100 and PIP 111 can therefore be varied to apply pressure over the contact area. In some examples, the surface of the developer roller 100 and/or PIP 111 may be deformed as the respective surfaces are engaged. For example, if the engagement force is large, the contact area may be increased when compared with a relatively small engagement force.

FIG. 1*b* shows the developer roller 100 in isolation. The developer roller 100 has a first end (e.g. a front end) 101*a* and a second end (e.g. a rear end) 101*b*, each of which is moved into and out of engagement with the PIP 111 by a separate engagement device (not shown). If there is a time difference between the first end 101*a* of the developer roller contacting the PIP 111 and the second end 101*b* of the developer roller contacting the PIP 111, the quality of the printed image will be reduced. Similarly, when the developer roller 100 is disengaged from the PIP 111 if there is a time difference between the first end 101*a* losing contact with the PIP 111 and the second end 101*b* losing contact with the PIP 111, print quality will be reduced. In particular, the leading edge (if the times of initial contact are different) and/or the trailing edge (if the times of losing contact are different) of the printed image will be diagonal to the print direction, rather than perpendicular.

Good print quality also often relies on a fixed and uniform engagement force being maintained between the developer roller and PIP during engagement. If the force applied at one end of the developer roller is higher than the force applied at the other end, this impacts the delicate balance between the electrical and mechanical forces applied to the ink which thus impacts the arrangement of the ink particles on the PIP. The consistent arrangement of the ink on the PIP on the micro scale facilitates achieving high print quality.

The engagement devices at each end of a BID can be synchronized by printing a test pattern, manually measuring the printed pattern, and adjusting the respective engagement devices based on those measurements. This process is time consuming and consumes ink and print target material (that is, the material onto which the ink is deposited to create a print product). Moreover, it does not provide for detecting synchronization issues before they become significant enough to cause a noticeable reduction in print quality.

The following examples comprise printing devices which can facilitate improved synchronization between engagement devices at each end of a developer roller, to improve print quality and printing efficiency. Some examples provide improved synchronization of the time at which each end contacts the PIP and subsequently loses contact with the PIP. Some examples provide improved synchronization of the engagement force at each end of the development roller. Some examples provide both improved synchronization of the time at which each end contacts the PIP and subsequently loses contact with the PIP, and improved synchronization of the engagement force at each end of the development roller.

Figure 2:
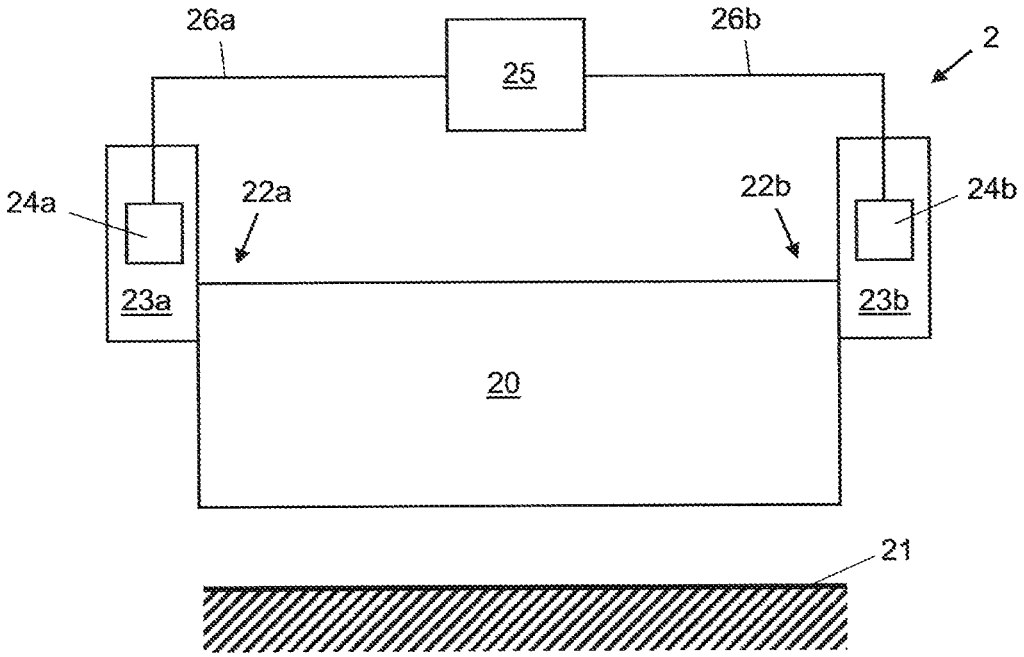
FIG. 2 is a schematic diagram showing an example printing device.

FIG. 2 is a schematic diagram showing such an example printing device 2. The printing device 2 comprises a component 20 to engage with a surface 21. The component 20 has a first part 22*a* which is drivable to engage and disengage with the surface 21 by a first engagement device 23*a* and a second part 22*b* which is drivable to engage and disengage with the surface 21 by a second engagement device 23*b*. The printing device 2 further comprises a first load sensor 24*a* to measure a load on the first engagement device 23*a* and a second load sensor 24*b* to measure a load on the second engagement device 23*b*. The printing device 2 further comprises a controller 25 to receive first load information from the first load sensor 24*a* and second load information from the second load sensor 24*b*. The controller 25 is further to determine whether or not to alter an operational parameter of the printing device 2, based on the received first load information and the received second load information.

The operational parameter may be a force-related operational parameter or a timing-related operational parameter. In some examples the controller 25 may be to determine whether or not to alter a force-related operational parameter and whether or not to alter a force-related operational parameter, based on the received first load information and the received second load information.

The first engagement device 23*a* may comprise a lever arm arranged to pivot about a fulcrum between an engaged position in which the first part 22*a* of the component 20 is engaged with the surface 21 and a disengaged position in which the first part 22*a* is spatially separated from the surface 21. The first engagement device 23*a* may further comprise a control mechanism to control movement of the lever arm under the influence of the biasing mechanism. Such a control mechanism may provide a "hard-stop" which limits the range of movement of the lever arm. The position of the hard-stop may be adjustable, and the first engagement device 23*a* may be to move the first part 22*a* into engagement with the surface 21 by adjusting the position of the hard-stop. The first engagement device 23*a* may comprise a biasing mechanism (such as a spring or pneumatic piston) to bias the lever arm into engagement with the control mechanism. The biasing mechanism may comprise a resilient biasing mechanism.

In a particular example, the control mechanism comprises a cam, and a motor to rotate the cam. The cam may transform rotational motion generated by the motor into linear motion, e.g. towards (or away from) the surface 21. Any suitable type of cam may be used. For example, the cam may be egg-shaped, an ellipse, eccentric or a snail-shaped cam. In this example the position of the hard-stop may be dependent on the rotational position of the cam. The first engagement device 23*a* may therefore be to engage the first part 22*a* with the surface 21 by activating the motor to rotate the cam to a rotational position such that the position of the hard-stop permits the lever to be in the engaged position.

The second engagement device 23*b* may comprise the same features as, and operate in the same manner as, the first engagement device 23*a*, and will therefore not be described in detail. The second engagement device 23*b* may be a mirror image of the first engagement device 23*a*.

The first load sensor 24*a* may comprise a strain gauge. The first load sensor 24*a* may comprise a plurality of strain gauges. The first load sensor 24*a* may comprise two strain gauges. The first load sensor 24*a* may comprise four strain gauges. In examples in which the first load sensor 24*a* comprises four strain gauges, the strain gauges may be provided in a full Wheatstone bridge configuration. A full Wheatstone bridge configuration may enable bending of the arm to be sensed, without also sensing any torsional or temperature-related strains that may be associated with the arm. Moreover, the full-bridge may enable the load signal to be amplified. In examples in which the first load sensor 24*a* comprises two strain gauges, a first one of the strain gauges may be provided on a first side of a lever arm of the first engagement device 23*a*, and a second one of the strain gauges may be provided on a second, opposite, side of the lever arm. In examples in which the first load sensor 24*a* comprises four strain gauges, a first pair of the strain gauges may be provided on a first side of a lever arm of the first engagement device 23*a*, and a second pair of the strain gauges may be provided on a second, opposite, side of the lever arm. The first side may be in tension and the second side in compression when the first part 22*a* is engaged with the surface 21. The first load sensor 24*a* is communicatively coupled to the controller 25 by a communications link 26*a*, which may be wired or wireless. The first load sensor 24*a* may thereby transmit the first load information to the controller 25.

The second load sensor 24*b* may comprise the same features as, and operate in the same manner as, the first load sensor 24*a*, and will therefore not be described in detail. The second load sensor 24*b* may be a mirror image of the first engagement device 23*b*. The second load sensor 24*b* is communicatively coupled to the controller 25 by a communications link 26*b*, which may be wired or wireless. The second load sensor 24*b* may thereby transmit the second load information to the controller 25.

The first load information may comprise a time-varying measurement signal. Such a time-varying measurement signal may indicate the engagement force during a time period covered by the signal. The first load information may comprise a time-series of load (force) values. The second load information may be of the same type and may have the same general features as the first load information, although a particular load value for a particular time comprised in the second load information will generally be different to a particular load value for the same particular time which is comprised in the first load information.

Figure 3:
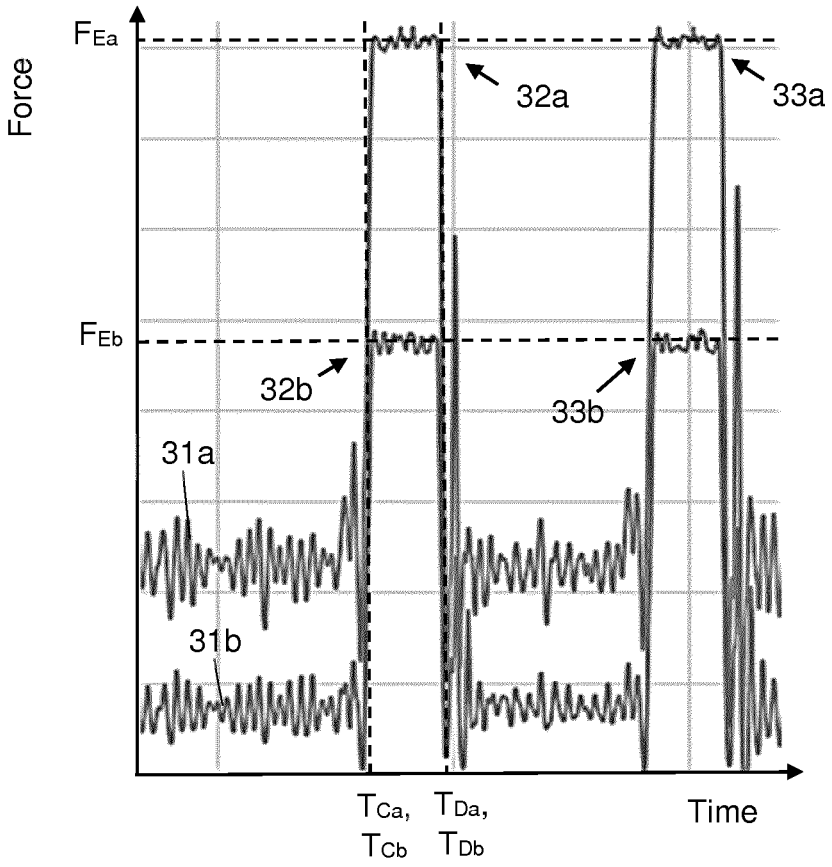
FIG. 3 is a chart showing example measurement signals acquired by an example printing device.

FIG. 3 shows example first load information and second load information. The first load information comprises a first time-varying force signal 31*a*, which indicates the engagement force measured by the first load sensor 24*a* across the time period covered by the signal 31*a*. The second load information comprises a second time-varying force signal 31*b*, which indicates the engagement force measured by the second load sensor 24*b* across the time period covered by the signal 31*b* (which in the example is the same as the time period covered by the signal 31*a*). In the illustrated example, the time period covered by the signals 31*a* and 31*b* includes two engaged sub-periods during which the component 20 is engaged with the surface 21. The two engaged sub-periods are represented by the plateaus 32*a-b* and 33*a-b* in the signals 1*a* and 31*b*. The two engaged sub-periods are separated by a disengaged sub-period during which the component 20 is not engaged with the surface 21. Each of the engaged sub-periods has the same features. Therefore, only the first engaged sub-period, corresponding to the signal plateaus 32*a* and 32*b*, will be discussed in detail. However; this discussion applies equally to the second engaged sub-period.

The contact time of the first part 22*a* of the component 20 is indicated by a sharp increase in the first force signal 31*a*. Similarly, the contact time of the second part 22*b* is indicated by a sharp increase in the second force signal 31*b*. The time at which the first part 22*a* of the component 20 contacts the surface 21 is $T_{Ca}$ and the time at which the second part 22*b* of the component 20 contacts the surface 21 is $T_{Cb}$. In the illustrated example, $T_{Ca}$ is substantially equal to $T_{Cb}$, indicating that the engagement timing of the first and second engagement devices 23*a*, 23*b* is synchronized. If the engagement timing of the first and second engagement devices 23*a*, 23*b* was not synchronized, there would be a time interval between $T_{Ca}$ and $T_{Cb}$.

The time at which the first part 22*a* of the component 20 loses contact with the surface 21 is indicated by a sharp decrease in the first force signal 31*a*. Similarly, the time at which the second part 22*b* loses contact with the surface 21 is indicated by a sharp decrease in the second force signal 31*b*. The time at which the first part 22*a* of the component 20 loses contact with the surface 21 is $T_{Da}$ and the time at which the second part 22*b* of the component 20 loses contact with the surface 21 is $T_{Db}$. In the illustrated example, $T_{Da}$ is substantially equal to $T_{Db}$, indicating that the disengagement timing of the first and second engagement devices 23*a*, 23*b* is synchronized. If the disengagement timing of the first and second engagement devices 23*a*, 23*b* was not synchronized, there would be a time interval between $T_{Da}$ and $T_{Db}$. The overall shape of each signal 31*a*, 31*b* during disengagement is substantially a mirror image of the overall shape during engagement.

It can be seen in the example of FIG. 3 that each of the signals 31*a*, 31*b* has a peak just before the contact times $T_{Ca}$, $T_{Cb}$, and a peak just after the times $T_{Da}$, $T_{Db}$ at which the component parts 22*a*, 22*b* lose contact with the surface 21. The peaks are caused by inertial forces generated by the structure of the particular engagement devices 23*a*, 23*b* used to generate the example data. In particular, in the illustrated example each engagement device 23*a*, 23*b* comprises an arm connected to a BID comprising the component part engaged by that engagement device. There is clearance between the arm and the BID, which means that when the arm stops moving after disengaging a component part comprising a developer roller of a BID inertial forces cause the BID to hit and then immediately lose contact with the engagement arm. This causes a peak in the force signal just after the disengagement time. The peaks just before the contact times are similarly caused by inertial forces causing the BID and the arm to briefly go into and out of contact once an engagement movement has been initiated.

The magnitude of a first engagement force (nip) $F_{Ea}$ between the first part 22*a* of the component 20 and the surface 21 is indicated by the difference between the average measured force before $T_{Ca}$ and the average measured force between $T_{Ca}$ and $T_{Ca}$. Similarly, the magnitude of a second engagement force (nip) $F_{Eb}$ between the second part 22*b* of the component 20 and the surface 21 is indicated by the difference between the average measured force before $T_{Cb}$ and the average measured force between $T_{Cb}$ and $T_{Db}$. In the illustrated example, $F_{Ea}$ is greater than $F_{Eb}$, indicating that the first engagement device 23*a* is applying more force than the second engagement device 23*b*. The measured force values during the disengaged sub-periods represent the "self-weight" of the component 20, which is not applied by the engagement devices 23*a*, 23*b* and which may differ between the first and second parts 22*a*, 22*b* of the component.

In some examples the controller 25 is to determine a first time at which the first part 22*a* of the component 20 engages or disengages with the surface 21 based on the first load information. The controller 25 may be to determine the first time at which the first part engages or disengages with the surface by determining whether any portion of the received first load information meets a predefined contact change criterion. A predefined contact change criterion may be defined such that a load information portion (e.g. a part of a time-varying load/force signal) is likely to meet the predefined contact change criterion if a contact change has occurred during acquisition of that load information portion, but is unlikely to meet the predefined contact change criterion if a contact change has not occurred during acquisition of that load information portion. For example, the predefined contact change criterion may be defined to exclude variations due to signal noise. Such a predefined contact change criterion may relate, for example, to a slope of a signal, a change in the slope of a signal, a magnitude of the signal, a change in magnitude of the signal, etc. The controller 25 may be to, responsive to a determination that a portion of the received first load information meets the predefined contact change criterion, determine a time associated with the portion of the received first load information which meets the predefined contact change criterion.

In some examples the controller 25 may be to determine a first time at which the first part 22*a* of the component 20 engages or disengages with the surface 21 based on the first load information by identifying a time corresponding to the start of a sharp increase in measured force. The controller 25 may be to use any suitable signal processing or other analysis techniques to determine the first time. For example, the controller 25 may be to compare consecutive force values. The controller 25 may be to determine a slope between consecutive force values and to determine a time of one of the consecutive force values to be the first time if the slope meets a predetermined criterion (e.g. a minimum gradient).

The controller 25 may further be to determine a second time at which the second part 22*b* of the component 20 engages or disengages with the surface 21 based on the second load information. The controller 25 may be to determine the second time in the same manner as it is to determine the first time.

In some examples the controller 25 is to determine whether or not to alter an operational parameter of the printing device 2 by comparing the determined first time with the determined second time. For example, the controller 25 may be to calculate a time difference $\Delta T$ between the determined first time and the determined second time. In some such examples the controller 25 may be to determine whether the calculated time difference $\Delta T$ meets a predefined time difference criterion. A predefined difference criterion may, for example, be defined such that a calculated time difference greater than a predefined time threshold value meets the predefined time difference criterion, and a calculated time difference smaller than the predefined time threshold value does not meet the predefined difference criterion. A predefined time difference criterion may be defined such that a calculated time difference greater than or equal to a predefined time threshold value meets the predefined time difference criterion. In a particular example a predefined time threshold may be 0.5 ms, although other values may be used in other examples.

In some examples, responsive to determining that the calculated time difference meets the predefined difference criterion, the controller 25 then determines to alter an operational parameter of the printing device 2. In such examples, responsive to determining that the calculated time difference does not meet the predefined time difference criterion, the controller determines not to alter an operational parameter of the printing device 2, does not determine to alter an operational parameter of the printing device 2, and/or determines to maintain a current value of operational parameter of the printing device 2.

Various operational parameters of the printing device 2 may be altered by the controller 25. The controller 25 may be to alter an individual operating parameter or may be to alter a combination of operating parameters. Operating parameters alterable by the controller 25 to synchronize the engagement and/or disengagement times of the first and second parts 22*a*, 22*b* of the component 20 include (but are not limited to):

- a length of a predetermined time period between activation of a first motor (e.g. a motor comprised in the first engagement device 23*a*) to engage the first part 22*a* of the component 20 and activation of a second motor (e.g. a motor comprised in the second engagement device) to engage the second part 22*b* of the component 20;
- a length of a predetermined time period between activation of a first motor (e.g. a motor comprised in the first engagement device 23*a*) to disengage the first part 22*a* of the component 20 and activation of a second motor (e.g. a motor comprised in the second engagement device) to disengage the second part 22*b* of the component 20;
- a time-related parameter (such as an activation time) of a first motor (e.g. a motor comprised in the first engagement device);
- a time-related parameter (such as an activation time) of a second motor (e.g. a motor comprised in the second engagement device);
- a position-related parameter (e.g. a rotational position) of a first motor (e.g. a motor comprised in the first engagement device);
- a position-related parameter (e.g. a rotational position) of a second motor (e.g. a motor comprised in the second engagement device);
- a velocity-related parameter (e.g. rotational velocity) of a first motor (e.g. a motor comprised in the first engagement device);
- a velocity-related parameter (e.g. rotational velocity) of a second motor (e.g. a motor comprised in the second engagement device).

In some examples in which each of the first and second engagement devices 23*a*, 23*b* comprises a motor connected to a cam that moves an arm, each rotation angle of the cam is related to a movement of the component 20. Therefore, the controller 25 may be to store a rotational position of a motor (e.g. step number, or position according to a motor position encoder) of an engagement device at a time at which the associated component part 22*a*, 22*b* contacts the surface 21.

The motor can thereby be restarted from that same position when it is operated by the controller 25 to disengage the component part from the surface 21.

In some examples, the controller 25 is to, responsive to a determination to alter an operational parameter of the printing device 2, determine a new value for the operational parameter based on a difference between the first load information and the second load information. In examples in which the difference is a time difference (e.g. the calculated time difference ΔT discussed above), the controller 25 may be to determine a new value for a timing-related operational parameter (e.g. one of the operational parameters listed above). The controller 25 may be to determine a new value for a timing-related operational parameter by adding subtracting, or performing any other type of calculation based on the calculated time difference ΔT from a current value of that time-related operational parameter. The controller 25 may be to alter an activation time of a first motor comprised in the first engagement device 23*a* or an activation time of a second motor comprised in the second engagement device 23*b* by, for example, an amount equal to a calculated difference between the first contact time and the second contact time (that is, by an amount equal to ΔT). In some examples the controller 25 may be to alter a length of a predetermined time period between activation of a first motor comprised in the first engagement device 23*a* to engage (or disengage) the first part 22*a* and activation of a second motor comprised in the second engagement device 23*b* to engage (or disengage) the second part 22*b* by an amount equal to a calculated difference between the first contact time and the second contact time (that is, by an amount equal to ΔT). In some examples the controller 25 may further be to output a control signal (e.g. to a motor or other component of an engagement device 23*a*, 23*b*) to cause the operational parameter to be changed to the determined new value.

In some examples, the controller 25 is to continuously monitor an engagement (or disengagement) time difference (e.g. the calculated time difference ΔT) during a printing operation of the printing device 2. The controller 25 may thereby detect any difference between the first and second engagement (or disengagement) times before such a difference is large enough to noticeably affect the print quality. As described above, the controller 25 may be to alter an operational parameter of the printing device to reduce or eliminate such an engagement (or disengagement) time difference. The controller 25 may thereby maintain an engagement (or disengagement) time difference to be less than a certain amount (which may correspond to the predefined time threshold value of a predefined time criterion, as described above). The amount may be such that an engagement (or disengagement) time difference less than this amount does not noticeably affect the print quality. The controller 25 may control a first engagement time, a first disengagement time, a second engagement time and/or a second disengagement time in real-time.

As discussed above, the engagement force between the first and second parts 22*a*, 22*b* of the component 20 and the surface 21 when the component 20 is engaged with the surface 21 may be synchronized. Therefore, in some examples the controller 25 is to determine a first engagement force between the first part 22*a* of the component 20 and the surface 21 based on the first load information. In some examples (e.g. the example illustrated by FIG. 3) in which the first load information comprises a first time-varying force signal, the controller 25 may be to determine the first engagement force to be equal to a difference between a value of the force signal during a disengaged sub-period of the signal (that is, a sub-period during which the first part 22*a* was not in contact with the surface) and a value of the force signal during an engaged sub-period of the signal (that is, a sub-period during which the first part 22*a* was in contact with the surface 21). In some examples the controller 25 may be to determine the first engagement force to be equal to a difference between an average value of the force signal during a period before a time at which the first part 22*a* contacts the surface 21 and an average value of the force signal during a period when the first part 22*a* is in contact with the surface 21 (e.g. the force value $F_{Ea}$). The controller 25 may be to use any suitable signal processing or other analysis techniques to determine the first engagement force.

The controller 25 may further be to determine a second engagement force between the second part 22*b* of the component 20 and the surface 21 based on the second load information. The controller 25 may be to determine the second engagement force in the same manner as it is to determine the first engagement force.

In some examples the controller 25 is to determine whether or not to alter an operational parameter of the printing device based on the determined first engagement force and the determined second engagement force. For example, the controller 25 may be to determine whether or not to alter an operational parameter of the printing device 2 by comparing the determined first time with the determined second time. For example, the controller 25 may be to calculate a difference ΔF between the determined first engagement force and the determined second engagement force. In some such examples the controller 25 may be to determine whether the calculated engagement force difference ΔF meets a predefined force difference criterion. A predefined force difference criterion may, for example, be defined such that a calculated engagement force difference ΔF greater than a predefined threshold value meets the predefined force difference criterion, and a calculated engagement force difference ΔF smaller than the predefined threshold value does not meet the predefined force difference criterion. A predefined force difference criterion may be defined such that a calculated engagement force difference ΔF greater than or equal to a predefined threshold value meets the predefined force difference criterion.

In some examples, responsive to determining that the calculated engagement force difference ΔF meets the predefined force difference criterion, the controller 25 then determines to alter an operational parameter of the printing device 2. In such examples, responsive to determining that the calculated engagement force difference ΔF does not meet the predefined difference criterion, the controller may be to perform at least one of: determine not to alter an operational parameter of the printing device 2; not determine to alter an operational parameter of the printing device 2; determine to maintain a current value of operational parameter of the printing device 2.

In some examples the controller 25 may be to determine whether or not to alter an operational parameter of the printing device additionally based on a predetermined target engagement force. For example, the controller 25 may be to determine whether each of the first engagement force and the second engagement force is equal or substantially equal to a predetermined target engagement force. The controller 25 may be to determine whether a total engagement force (that is, a sum of the first engagement force and the second engagement force) is equal or substantially equal to a predetermined target engagement force. In some examples, the controller 25 may be to determine to alter an operational parameter of the printing device if one or more of the first engagement force and the second engagement force is not equal or substantially equal to a predetermined target engagement force. In some examples the controller 25 may be to determine to alter an operational parameter of the printing device if a total engagement force is not equal or substantially equal to a predetermined target engagement force.

Operating parameters alterable by the controller 25 to synchronize the engagement force between the first part 22*a* and the surface 21 and between the second part 22*b* and the surface 21 (that is, force-related operating parameters) include (but are not limited to):

- an operational parameter of a first motor (e.g. a motor comprised in the first engagement device 23*a*);
- an operational parameter of a second motor (e.g. a motor comprised in the second engagement device 23*b*);
- a rotational position of a first motor (e.g. a motor comprised in the first engagement device 23*a*);
- a rotational position of a second motor (e.g. a motor comprised in the second engagement device 23*b*);
- a torque output by a first motor (e.g. a motor comprised in the first engagement device 23*a*);
- a torque output by a second motor (e.g. a motor comprised in the second engagement device 23*b*);
- a configuration of a first control mechanism (e.g. a rotational position of a cam) comprised in the first engagement device 23*a* to adjust an engagement force between the first part 22*a* and the surface 21);
- a configuration of a second control mechanism (e.g. a rotational position of a cam) comprised in the second engagement device 23*b* which is to adjust an engagement force between the second part 22*b* and the surface 21).

In some examples, the controller 25 is to, responsive to a determination to alter an operational parameter of the printing device 2, determine a new value for a force-related operational parameter based on a difference between the first load information and the second load information. In examples in which the difference is an engagement force difference (e.g. the calculated engagement force difference ΔF discussed above), the controller 25 may be to determine a new value for a force-related operational parameter (e.g. one of the force-related operational parameters listed above) based on the calculated engagement force difference ΔF. For example, the determined new value may be such that when the printing device 2 is operating in accordance with the determined new value, there is no significant difference between the first engagement force between the first part 22*a* and the surface 21 and the second engagement force between the second part 22*b* and the surface 21. A significant difference may be, for example, a difference that would meet the predefined engagement force difference criteria discussed above. In some examples the controller 25 may further be to output a control signal (e.g. to a motor or other component of an engagement device 23*a*, 23*b*) to cause the force-related operational parameter to be changed to the determined new value.

In some examples the controller 25 may be to determine a new value for a force-related operational parameter based on a predefined target engagement force. For example, the determined new value may be such that when the printing device 2 is operating in accordance with the determined new value, the engagement force between the first part 22*a* and the surface 21 is equal or substantially equal to the predefined target engagement force and the engagement force between the second part 22*a* and the surface 21 is equal or substantially equal to the predefined target engagement force. The determined new value may be such that when the printing device 2 is operating in accordance with the determined new value, the total engagement force between the component 20 and the surface 21 is equal or substantially equal to the predefined target engagement force.

Figure 4A:
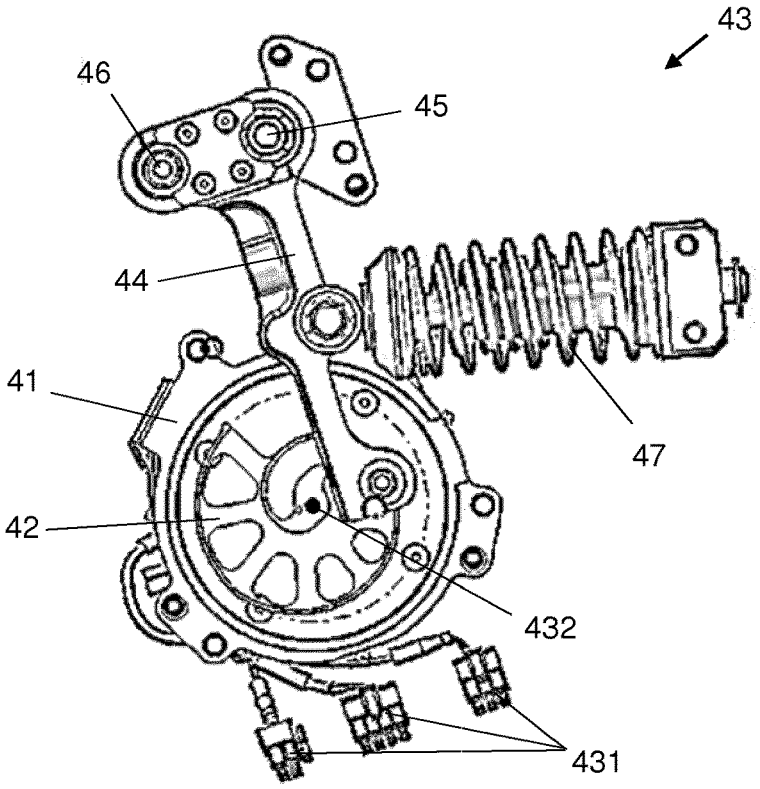
FIG. 4A is a schematic diagram showing an example engagement device for an example printing device.
Figure 4B:
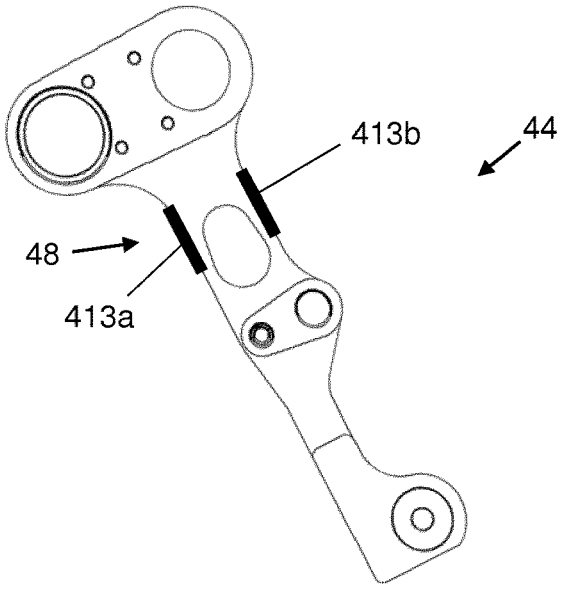
FIG. 4B is a schematic diagram showing an arm of the example engagement device of FIG. 4A.

In some examples, the controller 25 is to continuously monitor an engagement force difference (e.g. the calculated engagement force difference ΔF) and/or a total engagement force during a printing operation of the printing device 2. The controller 25 may thereby detect any difference between the first and second engagement forces before such a difference is large enough to noticeably affect the print quality. The controller may thereby detect any difference between a total engagement force and a predefined target engagement force before such a difference is large enough to affect print quality. As described above, the controller 25 may be to alter an operational parameter of the printing device to reduce or eliminate such an engagement force difference. The controller 25 may thereby maintain a difference between the first and second engagement forces to be less than a certain amount (which may correspond to the predefined threshold value of a predefined force criterion, as described above). The amount may be such that an engagement force difference less than this amount does not noticeably affect the print quality. The controller 25 may further maintain a difference between a total engagement force and a predefined target engagement force) to be less than a certain amount. The amount may be such that a difference less than this amount does not noticeably affect the print quality. The controller 25 may control the first engagement force, the second engagement force and/or the total engagement force in real-time. In some examples the printing device 2 comprises a liquid electrophotographic printer. In such examples the component may comprise a BID having a developer roller (e.g. of the type described above), and the surface 21 may be comprised in a PIP. The first part of the component may comprise a front (with respect to an in-use orientation of the printing device) part, and the second part may comprise a rear part. Similarly the first engagement device may comprise a front BID engagement device and the second engagement device may comprise a rear BID engagement device. FIGS. 4A and 4B show an example engagement device (which may be either a first/front engagement device or a second/rear engagement device) for an example printing device comprising a liquid electrophotographic printer.

FIG. 4A shows an example engagement device 43, for a printing device such as the example printing device 2 described above. The engagement device 43 comprises a motor 41, controllable by a controller (e.g. a controller of a printing device in which the engagement device 43 is comprised), which can be operated to generate rotational motion in both the clockwise and anti-clockwise direction. The motor 41 is to receive data (e.g. from the controller) and power (e.g. from a power supply of the printing device in which the engagement device 43 is comprised) via connectors 431. The rotational motion generated by the motor 31 is transformed into linear motion by a control mechanism 42, which in the illustrated example comprises a snail cam. The motor 41 may directly cause the cam 42 to rotate about an axis 432. Alternatively, the motor 41 may indirectly cause the cam 42 to rotate, for example via gears (not shown). Rotation of the cam 42 about the axis 432 causes linear motion to be generated, for example, in a direction perpendicular to the axis of rotation 432. An object in contact with the cam 42 will be moved due to the action of the linear motion. In the particular example, the linear motion is achieved by a parallelogram linkage (not shown) between the engagement device 43 and a BID unit connected to the engagement device 43.

The engagement device 43 further comprises a lever arm 44 which is to rotate about a pivot axis 45. FIG. 4B shows the arm 44 in isolation. One end of the arm 44 abuts the cam 42 and the other end is connectable to a BID unit via a truss connection point 46. Rotation of the arm 44 causes the position of a BID unit (and a developer roller comprised in the BID unit) to move relative to a PIP of the printing device in which the engagement device 43 is comprised, to bring the developer roller into or out of contact with the PIP, and/or to adjust the engagement force between the developer roller and the PIP.

The engagement device further comprises a coupling device between the arm and the cam, which in this example is a spring 47. The spring 47 biases the arm 44 onto the cam 42, such that it contacts, or abuts the cam 42. This continuous abutment allows the action of the motor 41 and cam 42 to control the distance between the developer roller and the PIP, and also the engagement force between the developer roller and the PIP, as will be explained further below. Although the spring 47 is depicted as a compression spring to push the arm 44 onto the cam 42, other arrangements/springs or other coupling devices may achieve the same goal. For example, a spring, such as a tension spring, may be provided so as to pull the arm 44 onto the cam 42.

Linear motion generated by the cam 42 causes the arm 44 to rotate about the pivot axis 45. The cam 42 is rotatable between a first rotational position in which the distance between the center of rotation 432 of the cam 42 and the end of the arm 44 which abuts the cam 42 is maximum, and a second rotational position in which the distance between the center of rotation 432 of the cam 42 and the end of the arm 44 which abuts the cam 42 is minimum. The developer roller is disengaged from the PIP when the cam 42 is in the first rotational position. When the cam 42 is in the second rotational position the developer roller is engaged with the PIP with a maximal engagement force. When the cam 42 is in an intermediate rotational position between the first rotational position and the second rotational position the developer will be not engaged with the PIP (but will be closer to the PIP than when the cam 42 is in the first rotational position) or will be engaged with the PIP with a less than maximal engagement force. The engagement force can therefore be increased by rotating the cam toward the second rotational position.

As discussed above, to ensure good print quality the front and rear engagement devices of a printing device may be synchronized such that the times at which the front and rear ends of a developer roller contact the PIP during initial engagement of the developer roller with the PIP (and subsequently lose contact with the PIP during disengagement) are the same. The front and rear engagement devices may also be synchronized such that the engagement forces between the front and rear ends of the developer roller and the PIP are the same.

To enable such synchronization, a load sensor 48 is provided on the example engagement device 43, to measure a load experienced by the engagement device 43. The load sensor 48 comprises a first pair of strain gauges 413*a* attached to a first side of the arm 44, and a second pair of strain gauges 413*b* attached to a second, opposite side of the arm 44. The first side may experience a compression load when a developer roller of a BID unit connected to the engagement device 43 is engaged with a PIP, and the second side may experience a tension load when the developer roller is engaged with the PIP. In the illustrated example the first and second strain gauges 413*a*, 413*b* are provided according to a full Wheatstone bridge arrangement. Load experienced by the arm 44 may thereby be measured very accurately (for example with an error of 5N or less). The load sensor 48 is communicatively coupled to a controller (e.g. a controller of a printing device in which the engagement device 43 is comprised) and may be to provide load measurement data (e.g. measured load values, a time-varying load signal, or the like) to the controller. The load sensor 48 may have any of the features of the example load sensors 24*a* and 24*b* described above.

Figure 5:
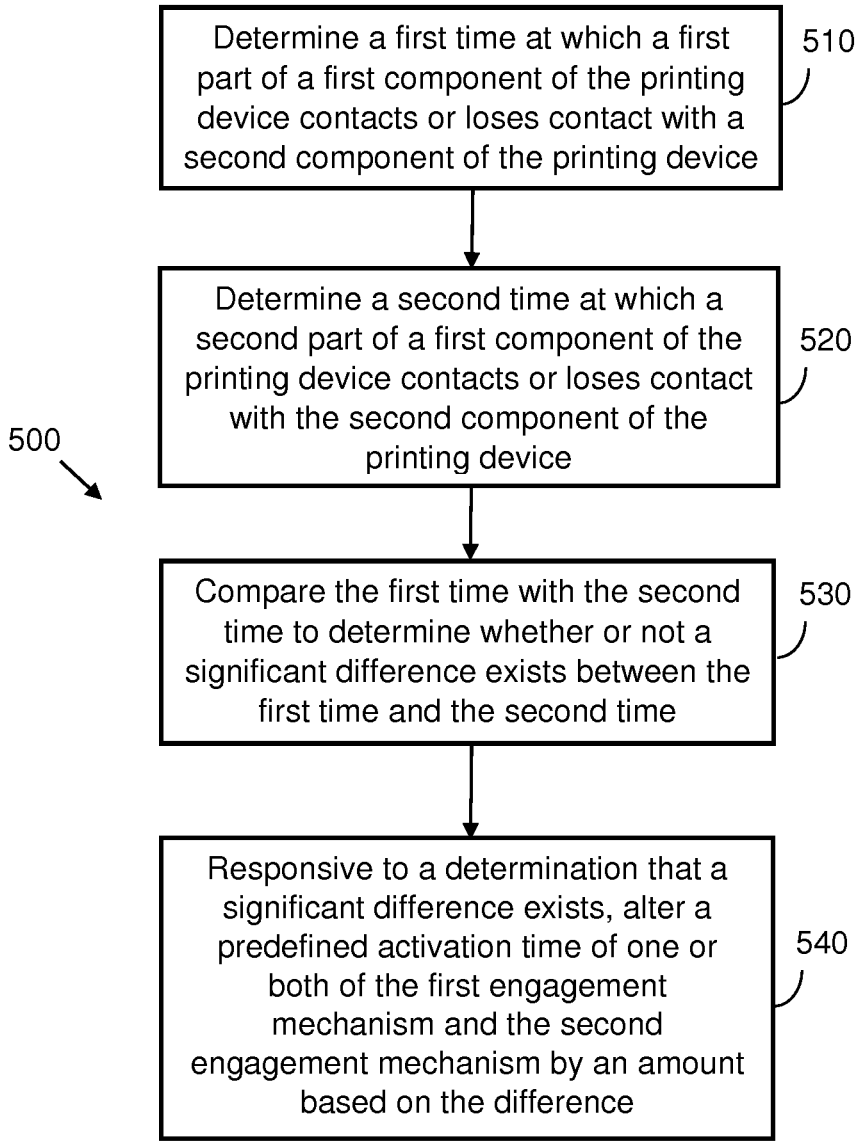
FIG. 5 is a flow diagram showing an example method for adjusting an operational parameter of a printing device.

FIG. 5 is a flow diagram showing an example method 500 for adjusting an operational parameter of a printing device. The method can be performed by the example printing device 2 described above. In some examples, the method is performed by the controller 25 of the example printing device 2 during operation of the printing device 2.

In block 510, a first time at which a first part of a first component (e.g. a front end of a developer roller) of the printing device contacts or loses contact with a second component (e.g. a PIP) of the printing device is determined, based on first load data relating to the load on a first engagement mechanism to move the first part into and out of contact with the second component. The first time may be determined in any of the ways discussed above in relation to the operation of the example printing device 2.

In block 520, a second time at which a second part of the first component (e.g. a rear end of a developer roller) of the printing device contacts or loses contact with the second component is determined, based on second load data relating to the load on a second engagement device to move the second part into and out of contact with the second component. The second time may be determined in any of the ways discussed above in relation to the operation of the example printing device 2.

In block 530 the first time is compared with the second time to determine whether or not a significant difference exists between the first time and the second time. A significant difference may be, for example, a difference meeting a predefined time difference criterion such as the predefined time difference criterion described above in relation to the operation of the example printing device 2. A significant difference may be a difference which is likely to noticeably affect print quality. A significant difference may be a difference which is reliably detectable by the printing device 2 but which is not likely to noticeably affect print quality. Block 530 may be performed in any of the manners described above in relation to the operation of the example printing device 2.

In block 540, responsive to a determination that a significant difference exists, a predefined activation time of one or both of the first engagement mechanism and the second engagement mechanism is altered by an amount based on the difference. The amount by which the predefined activation time is altered may be determined in any of the ways described above in relation to the operation of the example printing device 2. The predefined activation time may be altered in any of the ways described above in relation to the operation of the example printing device 2.

The method 500 may be performed by a printing device continuously during a printing operation of that printing device. The method 500 may be performed at regular intervals during a printing operation. The method 500 may be performed at a preset time during a printing operation, or at several preset times during a printing operation. The number of times that the method 500 is performed during a given printing operation may depend on an attribute of the printing operation (e.g. size, duration, type of print media, or the like). The method 500 may be performed in response to the occurrence of a fault with the printing device, particularly if the nature of the fault is such that it could affect the synchronization of the engagement devices.

Figure 6:
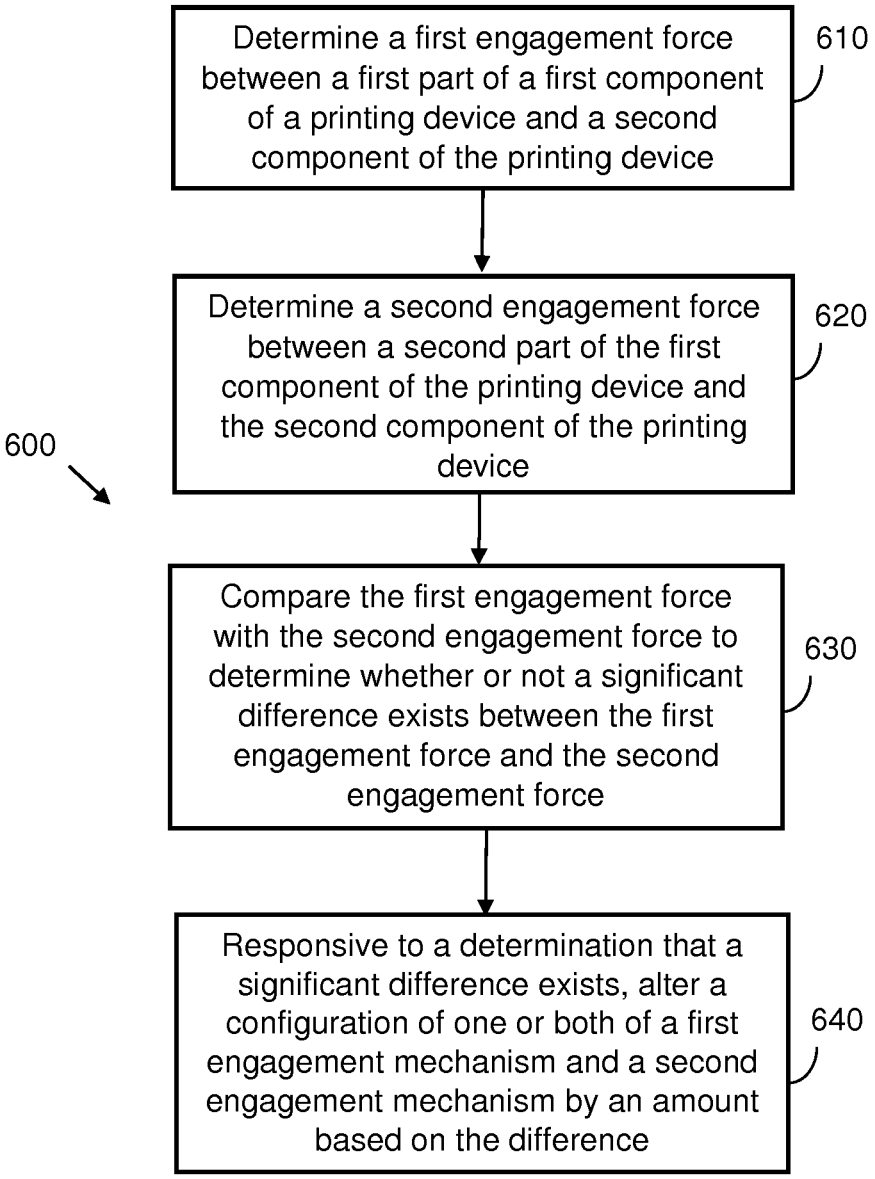
FIG. 6 is a flow diagram showing a further example method for adjusting an operational parameter of a printing device.

FIG. 6 is a flow diagram showing an example method 600 for adjusting an operational parameter of a printing device. The method can be performed by the example printing device 2 described above. In some examples, the method is performed by the controller 25 of the example printing device 2 during operation of the printing device 2.

In block 610, a first engagement force between a first part of a first component (e.g. a front end of a developer roller) of the printing device and a second component (e.g. a PIP) of the printing device is determined, based on first load data relating to the load on a first engagement mechanism to adjust an engagement force between the first component and the second component. The first engagement force may be determined in any of the ways discussed above in relation to the operation of the example printing device 2.

In block 620, a second engagement force between a second part of the first component (e.g. a rear end of a developer roller) of the printing device and the second component is determined, based on second load data relating to the load on a second engagement device to adjust an engagement force between the first component and the second component. The second engagement force may be determined in any of the ways discussed above in relation to the operation of the example printing device 2.

In block 630 the first engagement force is compared with the second engagement force to determine whether or not a significant difference exists between the first engagement force and the second engagement force. A significant difference may be, for example, a difference meeting a predefined force difference criterion such as the predefined force difference criterion described above in relation to the operation of the example printing device 2. A significant difference may be a difference which is likely to noticeably affect print quality. A significant difference may be a difference which is reliably detectable by the printing device 2 but which is not likely to noticeably affect print quality. Block 630 may be performed in any of the manners described above in relation to the operation of the example printing device 2.

In block 640, responsive to a determination that a significant difference exists, a configuration of one or both of the first engagement mechanism and the second engagement mechanism is altered by an amount based on the difference. The amount by which the configuration is altered may be determined in any of the ways described above in relation to the operation of the example printing device 2. The configuration may be altered in any of the ways described above in relation to the operation of the example printing device 2.

Figure 7:
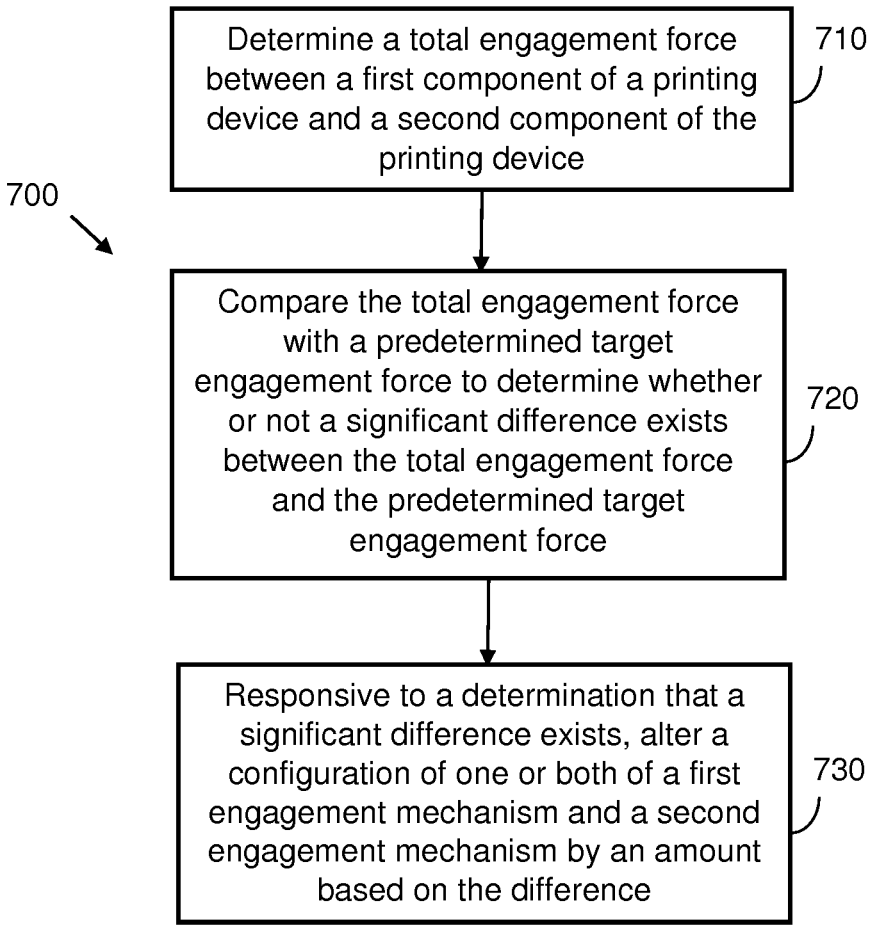
FIG. 7 is a flow diagram showing a further example method for adjusting an operational parameter of a printing device.

FIG. 7 is a flow diagram showing an example method 700 for adjusting an operational parameter of a printing device. The method can be performed by the example printing device 2 described above. In some examples, the method is performed by the controller 25 of the example printing device 2 during operation of the printing device 2.

In block 710, a total engagement force between a first component (e.g. a developer roller) of the printing device and a second component (e.g. a PIP) of the printing device is determined. In some examples determining a total engagement force comprises determining a first engagement force between a first part of the first component and a second engagement force between a second part of the first component. The first engagement force may be determined, for example, in the manner described above in relation to block 610 of FIG. 6. The second engagement force may be determined in the manner described above in relation to block 620 of FIG. 6. The total engagement force may be determined based on the first engagement force and the second engagement force, in any suitable manner. For example, the total engagement force may be determined by calculating the sum of the first engagement force and the second engagement force.

In block 720 the total engagement force is compared with a predetermined target engagement force (which may have any of the features of the predetermined target engagement force described above in relation to the operation of the example printing device 2) to determine whether or not a significant difference exists between the total engagement force and the predetermined target engagement force. A significant difference may be, for example, a difference meeting a predefined force difference criterion such as the predefined force difference criterion described above in relation to the operation of the example printing device 2. A significant difference may be a difference which is likely to noticeably affect print quality. A significant difference may be a difference which is reliably detectable by the printing device 2 but which is not likely to noticeably affect print quality. Block 720 may be performed in any of the manners described above in relation to the operation of the example printing device 2.

In block 730, responsive to a determination that a significant difference exists, a configuration of one or both of the first engagement mechanism and the second engagement mechanism is altered by an amount based on the difference. The amount by which the configuration is altered may be determined in any of the ways described above in relation to the operation of the example printing device 2. The configuration may be altered in any of the ways described above in relation to the operation of the example printing device 2.

Either or both of the methods 600, 700 may be performed by a printing device continuously during a printing operation of that printing device. The methods 600, 700 may be performed by a printing device during a time period in which the first component is engaged with the second component, and may not be performed at other times at which the first component is not engaged with the second component The methods 600, 700 may be performed at regular intervals during a time period in which the first component is engaged with the second component. The methods 600, 700 may be performed at a preset time during a printing operation, or at several preset times during a printing operation. The number of times that the method 600 (and/or the method 700) is performed during a given printing operation may depend on an attribute of the printing operation (e.g. size, duration, type of print media, or the like). The methods 600, 700 may be performed in response to the occurrence of a fault with the printing device, particularly if the nature of the fault is such that it could affect the synchronization of the engagement devices.

A calibration operation of a printing device, e.g. the example printing device 20, may comprise performing all of the methods 500, 600 and 700, or any combination of the methods 500, 600, 700. In a particular example, a printing device is to perform a calibration operation (e.g. during an initial set-up of the printing device, according to a periodic calibration schedule, or in response to a fault occurring with the printing device) by first performing the method 500, then performing the method 600, then performing the method 700.

Certain system components and methods described herein may be implemented by way of non-transitory computer program code that is storable on a non-transitory storage medium. In some examples, the controller 25 of the example printing device 2 described above may comprise a non-transitory computer readable storage medium comprising a set of computer-readable instructions stored thereon. The controller 25 may further comprise at least one processor. Alternatively, controllers 25 may implement all or parts of the methods described herein.

Figure 8:
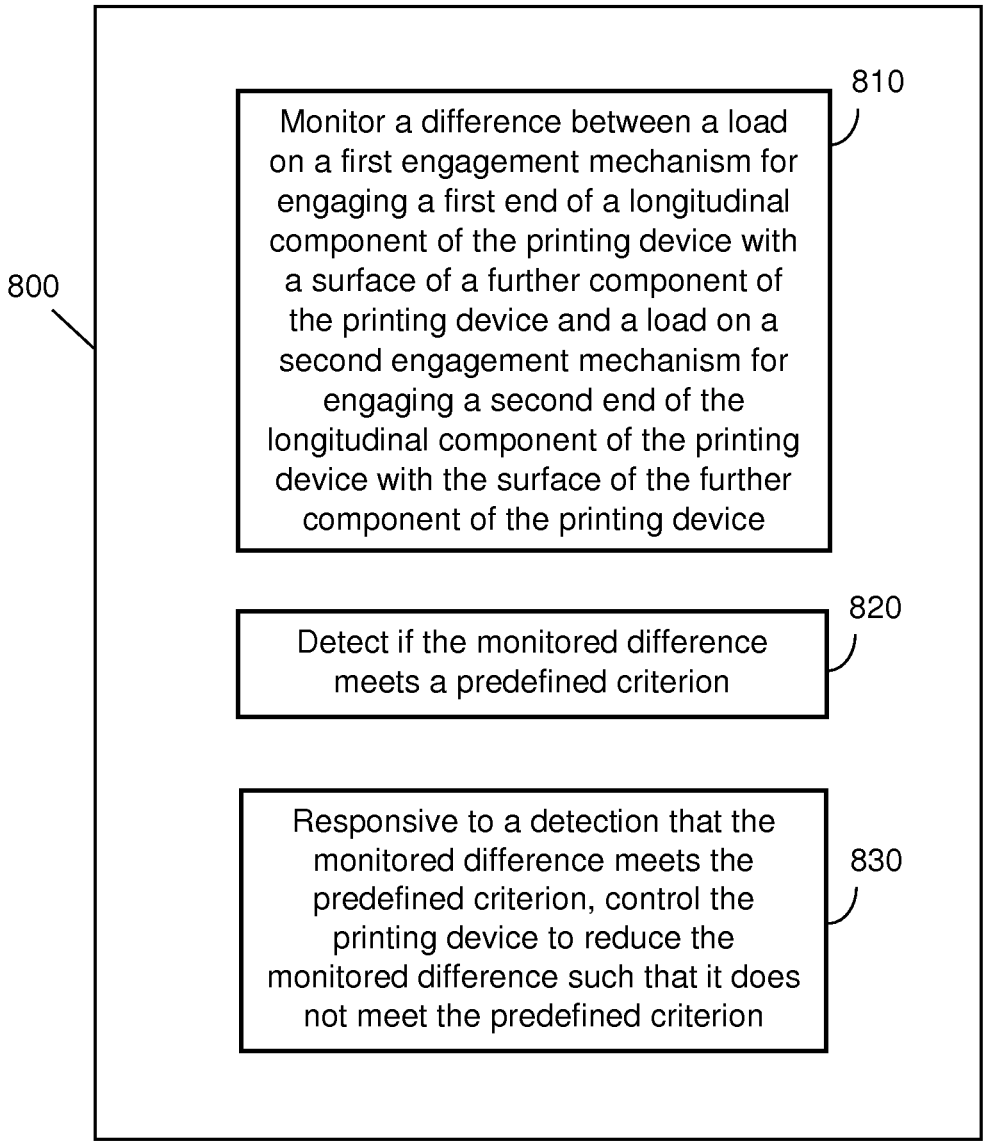
FIG. 8 is a schematic diagram showing an example set of computer readable instructions within a non-transitory computer-readable storage medium.

FIG. 8 shows an example of such a non-transitory computer-readable storage medium 800 comprising a set of computer readable instructions 810-830 which, when executed by a processor of a printing device, cause the processor to perform a method according to examples described herein. The computer readable instructions 810-830 may be retrieved from a machine-readable media, e.g. any media that can contain, store, or maintain programs and data for use by or in connection with an instruction execution system. In this case, machine-readable media can comprise any one of many physical media such as, for example, electronic, magnetic, optical, electromagnetic, or semiconductor media. More specific examples of suitable machine-readable media include, but are not limited to, a hard drive, a random access memory (RAM), a read-only memory (ROM), an erasable programmable read-only memory, or a portable disc.

When the computer readable instruction 810 is executed by a processor of a printing device, it causes the processor to monitor a difference between a load on a first engagement mechanism for engaging a first end of a longitudinal component of the printing device with a surface of a further component of the printing device and a load on a second engagement mechanism for engaging a second end of the longitudinal component of the printing device with the surface of the further component of the printing device. When the computer readable instruction 820 is executed by a processor of a printing device, it causes the processor to detect if the monitored difference meets a predefined criterion. When the computer readable instruction 830 is executed by a processor of a printing device, it causes the processor to, responsive to a detection that the monitored difference meets the predefined criterion, control the printing device to reduce the monitored difference such that it does not meet the predefined criterion.

In a further example (not illustrated) of a non-transitory computer-readable storage medium comprising a set of computer readable instructions which, when executed by a processor of a printing device, cause the processor to perform a method according to examples described herein, the non-transitory computer-readable storage medium comprises first, second and third computer-readable instructions. When the first computer readable instruction is executed by a processor of a printing device, it causes the processor to monitor a difference between a sum of the load on a first engagement mechanism for engaging a first end of a longitudinal component of the printing device with a surface of a further component of the printing device and a load on a second engagement mechanism for engaging a second end of the longitudinal component of the printing device with the surface of the further component of the printing device, and a predetermined target load. When the second computer readable instruction is executed by a processor of a printing device, it causes the processor to detect if the monitored difference meets a predefined criterion. When the third computer readable instruction is executed by a processor of a printing device, it causes the processor to, responsive to a detection that the monitored difference meets the predefined criterion, control the printing device to reduce the monitored difference such that it does not meet the predefined criterion.

While certain examples have been described above in relation to liquid electrophotographic printing, other examples can be applied to dry electrophotographic printing or other types of printing. Furthermore, although the examples described above relate to printing devices, the same teachings may also be applied to other systems where synchronization is to be achieved and/or maintained between two engagement mechanisms for engaging first and second parts of a first component with a second component.

The preceding description has been presented to illustrate and describe examples of the principles described. This description is not intended to be exhaustive or to limit these principles to any precise form disclosed. Many modifications and variations are possible in light of the above teaching.

The invention claimed is:

1. A printing device comprising:

a photo imaging surface;

a developer roller to transfer ink or toner to the photo imaging surface, the developer roller having a first end and a second end opposite the first end;

a first engagement device operatively connected to the first end to move the first end into and out of engagement with the surface;

a second engagement device operatively connected to the second end to move the second end into and out of engagement with the surface;

a first load sensor to measure a load on the first engagement device;

a second load sensor to measure a load on the second engagement device; and a controller to:

receive first load information from the first load sensor and second load information from the second load sensor;

determine a first time at which the first end engages or disengages with the surface based on the first load information;

determine a second time at which the second end engages or disengages with the surface based on the second load information; and determine whether or not to alter an operational parameter of the printing device by comparing the determined first time with the determined second time.

2. The printing device of claim 1, wherein the first engagement device comprises a first motor and the second engagement device comprises a second motor, and wherein the operational parameter comprises at least one of:

a length of a predetermined time period between activation of the first motor to move the first end into engagement with the surface and activation of the second motor to move the second end into engagement with the surface;

a length of a predetermined time period between activation of the first motor to move the first end out of engagement with the surface and activation of the second motor to move the second end out of engagement with the surface;

an activation time of the first motor;

an activation time of the second motor.

3. The printing device of claim 1, wherein the controller is to determine whether or not to alter an operational parameter of the printing device by:

calculating a difference between the determined first time and the determined second time; and determining whether the calculated difference meets a predefined difference criterion defined such that a calculated difference greater than a predefined threshold value meets the predefined difference criterion, and a calculated difference smaller than the predefined threshold value does not meet the predefined difference criterion.

4. The printing device of claim 1, wherein the controller is to:

determine the first time at which the first end engages or disengages with the surface by:

determining whether any portion of the received first load information meets a predefined contact change criterion; and responsive to a determination that a portion of the received first load information meets the predefined contact change criterion, determining a time associated with the portion of the received first load information which meets the predefined contact change criterion; and determine the second time at which the second end engages or disengages with the surface by:

determining whether any portion of the received second load information meets the predefined contact change criterion; and responsive to a determination that a portion of the received second load information meets the predefined contact change criterion, determining a time associated with the portion of the received second load information which meets the predefined contact change criterion.

5. A printing device comprising:

a photo imaging surface;

a developer roller to transfer ink or toner to the photo imaging surface, the developer roller having a first end and a second end opposite the first end;

a first engagement device operatively connected to the first end to move the first end into and out of engagement with the surface;

a second engagement device operatively connected to the second end to move the second end into and out of engagement with the surface;

a first load sensor to measure a load on the first engagement device;

a second load sensor to measure a load on the second engagement device; and a controller to:

receive first load information from the first load sensor and second load information from the second load sensor;

determine a first engagement force between the first end and the surface based on the first load information;

determine a second engagement force between the second end and the surface based on the second load information; and determine whether or not to alter an operational parameter of the printing device by comparing the determined first engagement force and the determined second engagement force.

6. The printing device of claim 5, wherein:

the first engagement device comprises a first motor and a first control mechanism driveable by the first motor to adjust an engagement force between the first end and the surface;

the second engagement device comprises a second motor and a second control mechanism driveable by the second motor to adjust an engagement force between the second end and the surface; and the operational parameter comprises at least one of:

an operational parameter of the first motor;

an operational parameter of the second motor;

a rotational position of the first motor;

a rotational position of the second motor;

a torque output by the first motor;

a torque output by the second motor;

a configuration of the first control mechanism;

a configuration of the second control mechanism.

7. The printing device of claim 6, wherein the first control mechanism comprises a first cam arranged such that the first engagement force between the first end and the surface is adjustable by altering the position of the first cam, and the second control mechanism comprises a second cam arranged such that the second engagement force between the second end and the surface is adjustable by altering the position of the second cam.

8. The printing device of claim 5, determine whether or not to alter an operational parameter of the printing device by:

calculating a difference between the first engagement force and the second engagement force; and determining whether the calculated difference meets a predefined difference criterion defined such that a calculated difference greater than a predefined threshold value meets the predefined difference criterion, and a calculated difference smaller than the predefined threshold value does not meet the predefined difference criterion.

9. The printing device of claim 8, wherein the controller is to:

responsive to a determination to alter an operational parameter of the printing device, determine an amount by which to alter the operational parameter based on the calculated difference, and alter the operational parameter by the determined amount.

10. A method for adjusting an operational parameter of a printing device having a photo imaging surface and a developer roller to transfer ink or toner to the photo imaging surface, the method comprising:

a first engagement mechanism moving a first end of the developer roller to engage or disengage the photo imaging surface;

determining a first time at which the first end of the developer roller engages or disengages the photo imaging surface, based on first load data relating to the load on the first engagement mechanism moving the first end of the developer roller to engage or disengage the photo imaging surface;

a second engagement mechanism moving a second end of the developer to engage or disengage the photo imaging surface;

determining a second time at which the second end of the developer roller engages or disengages the photo imaging surface, based on second load data relating to the load on the second engagement device moving the second end of the developer roller to engage or disengage the photo imaging surface;

comparing the first time with the second time to determine whether or not a significant difference exists between the first time and the second time; and responsive to a determination that a significant difference exists, altering a predefined activation time of one or both of the first engagement mechanism and the second engagement mechanism by an amount based on the difference.

11. A non-transitory computer readable storage medium comprising a set of computer-readable instructions stored thereon, which, when executed by a processor, cause the processor to, in a printing device:

monitor a difference between a load on a first engagement mechanism for engaging a first end of a developer roller of the printing device with a photo imaging surface of the printing device and a load on a second engagement mechanism for engaging a second end of the developer roller with the photo imaging surface;

detect if the monitored difference meets a predefined criterion; and responsive to a detection that the monitored difference meets the predefined criterion, control the printing device to reduce the monitored difference such that it does not meet the predefined criterion.

* * * * *